United States Patent [19]

Bleakney

[11] 4,442,431

[45] Apr. 10, 1984

[54] AIRBORNE MISSILE GUIDANCE SYSTEM

[75] Inventor: William M. Bleakney, Sherman Oaks, Calif.

[73] Assignee: Hughes Aircraft Company, El Segundo, Calif.

[21] Appl. No.: 163,535

[22] Filed: Jul. 12, 1971

[51] Int. Cl.[3] ..... F41G 7/28

[52] U.S. Cl. ..... 343/7 ED; 244/3.14; 343/5 CM; 343/16 M

[58] Field of Search ..... 244/3.14; 343/7 ED, 343/7.4, 5 CM, 16 M

[56] References Cited

U.S. PATENT DOCUMENTS

| | | | |
|---|---|---|---|
| 2,745,095 | 5/1956 | Stoddard | 244/3.13 X |
| 2,944,763 | 7/1960 | Grandgent et al. | 244/3.14 |
| 3,113,310 | 12/1963 | Standing | 343/16 R |
| 3,212,088 | 10/1965 | Alexander et al. | 343/7 ED X |
| 3,229,283 | 1/1966 | Hefter et al. | 343/7.4 X |
| 3,365,715 | 1/1968 | Stoney | 343/16 M X |
| 3,390,390 | 6/1968 | Vehrs, Jr. | 343/16 M |
| 3,727,219 | 4/1973 | Graham | 343/5 CM |
| 3,742,436 | 6/1973 | Jones | 343/5 CM |
| 3,768,096 | 10/1973 | Dentino | 343/5 CM |

*Primary Examiner*—T. H. Tubbesing

*Attorney, Agent, or Firm*—Leonard A. Alkov; A. W. Karambelas

[57] ABSTRACT

An airborne missile guidance system is disclosed which consists of an airborne radar system with a monopulse antenna. The system receives returns from a radar-illuminated ground area including a target and in conjunction with a synthetic array data processor displays the illuminated area in terms of range and doppler frequency. Range and azimuth cursors are generated and displayed. These cursors represent controllable range and doppler frequency values. Manual means are provided to control the display so that when the target is displayed under the cursors, they indicate its range and doppler frequency. The latter is used to adjust the monopulse null plane to point to the target. The airborne system further includes an arrangement for processing returns from a launched missile. These returns are processed to control the missile to fly along the monopulse null plane. Initially the missile flies in an elevation profile chosen for good transport efficiency. As it approaches the target range, it is controlled to fly downward at a range equal to the target range.

5 Claims, 13 Drawing Figures

AIRBORNE MISSILE GUIDANCE SYSTEM

The invention herein described was made in the course of or under a Contract or Subcontract thereunder with the Air Force.

BACKGROUND OF THE INVENTION

1. Field of the Invention:

The present invention relates to a radar guidance system and more particularly to an airborne radar system for guiding an airborne missile or the like to a ground target.

2. Description of the Prior Art:

Many air-to-ground missile guidance systems have been designed with various degrees of guidance accuracies. If the target to which a missile is to be directed is strong from a radiation reflection point of view, the problems of guiding a missile thereto are simple. System complexity greately increases with increased guidance accuracy and particularly in a system which is designed to guide a missile to a relatively weak target which can only be distinguished from radar returns of adjacent patches of ground by a trained operator. System complexity is further increased if the system is designed to direct the missile to a target from an aircraft which flies at a safe stand-off distance from the target.

Herebefore a radar ground mapping technology has been developed with which a history of the changes in range and azimuth of each element of ground of a selected resolution with respect to a flying aircraft is obtained, so that the various elements can be displayed to form a map of the ground. The map is updated at intervals which depend on the speed of the system. Such a mapping technique is referred to as a synthetic array radar mapping technique. With such a system the range and doppler frequency of any target of interest can be easily determined. The range is generally represented by a time delay from a time point of reference and the target azimuth is generally related to the doppler frequency shift.

Herebefore the range of a missile to a target could be controlled as it flies toward the target until the two are equal. However prior to the instant invention the target's doppler frequency shift or simply doppler frequency which is related to the target's azimuth could not be used to guide the missile in azimuth since the missile's frequency due to its velocity changes continuously and therefore could not be usefully made to equal the frequency of the ground target which is assumed to be stationary. Clearly a system capable of using the target's range and doppler frequency to guide a missile thereto would represent a significant advance in the art.

OBJECTS AND SUMMARY OF THE INVENTION

It is a primary object of the present invention to provide a new air-to-surface missile guidance system.

Another object of the present invention is to provide a new radar system in which the range and azimuth of a recognized target are determined and are used to guide the range and the azimuth of a missile which the system launches toward the target.

A further object of the invention is to provide a synthetic array radar command air launched missile system which guides an air launched missile to a surface or ground target.

Still another object of the present invention is to provide an air-to-surface missile guidance system in which a new concept is employed in the use of target frequency to control the missile's azimuth as it flies toward the target.

These and other objects of the invention are achieved by providing an airborne radar system which includes a monopulse antenna and a ground mapping capability. From the mapped ground a target of interest is recognized by an operator, who controls the system by means of manual controls, to cause the system to produce a time delay signal and a frequency which correspond to the range and doppler frequency of a recognized target. The frequency is used to control the null of the antenna difference pattern to lie in a plane in which the target is located. Alternately stated, the produced frequency is used to control the azimuth of the null plane of the antenna difference pattern, to coincide with the target azimuth. A missile which is launched toward the target is controlled in azimuth by controlling the missile to fly in the null plane of the difference pattern. The missile flies a suitable elevation profile until it reaches the target's range as determined by the time delay signal. When this range is reached the missile is commanded to fly down at a substantially constant range corresponding to the target's range, thereby resulting in a terminal drive on the target. Such a missile trajectory eliminates the need to know target altitude.

From this brief description of the invention it should be appreciated that the target's doppler frequency is used in an indirect manner to guide the azimuth of the moving missile, while the target's range or time delay signal is used to guide the missile's range and its trajectory for the terminal dive. In essence the target's frequency is used to control the null plane of difference pattern to coincide with the target's azimuth. It is this plane which is used as a reference for the missile's azimuth.

The teachings of the present invention may equally be employed in a case wherein a target with known coordinates is chosen. In such a case the known target coordinates are stored in the system and as the aircraft approaches the target at a safe standoff distance, the target's range in the form of a time delay signal and azimuth in the form of a doppler frequency are computed, and continuously updated as the aircraft's position relative to the target changes continuously. The target's doppler frequency is used to control the antenna's position so that target lies in the null plane, while the range (time delay signal) and the defined null plane are used for missile guidance.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
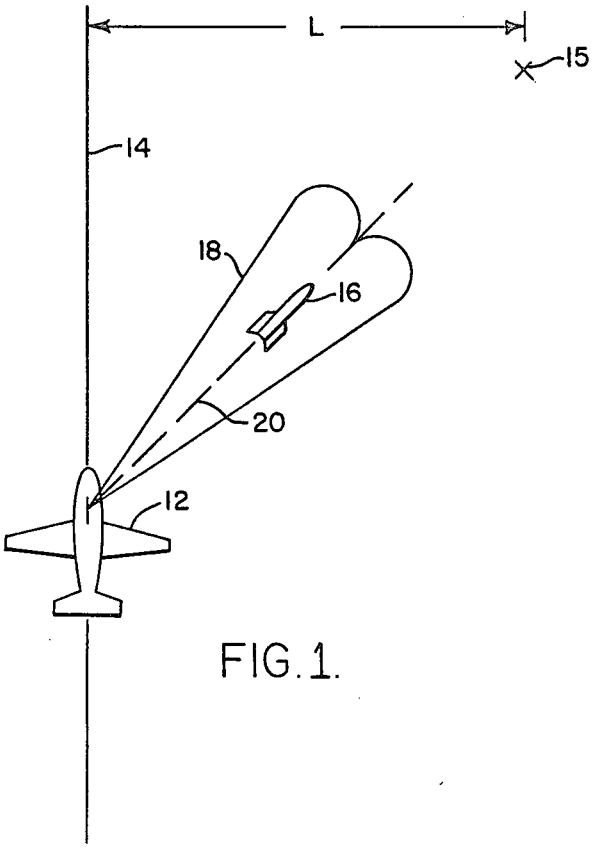
FIGS. 1–3 are simple diagrams useful in explaining the overall principles of operation of the present invention.

The principles of operation of the novel radar missile guidance system of the present invention may best be explained in connection with FIGS. 1 and 3. In FIG. 1 numeral 12 designates an aircraft assumed to be flying in a direction 14 at a safe standoff distance L from a target 15. The aircraft carries the missile guidance system which is designed to guide a missile 16 to target 15. The system is assumed to include a monopulse antenna whose difference pattern is designated by numeral 18 and the null plane of the difference pattern by dashed line 20.

In accordance with the teachings of the present invention the airborne system determines target position by indirect determination of target azimuth and target range with respect to the flying aircraft 12. As will be pointed out hereafter the system never calculates target range and azimuth directly. Rather it generates a time delay signal which corresponds to target range and a doppler frequency which is related to target azimuth. Since time and frequency can be measured very precisely, target position is very precisely determinable. The system controls the antenna position so that the null plane 20 of the difference pattern, hereafter referred to as the antenna null plane, passes through the target.

An airborne missile, such as missile 16, is then launched toward the target. Its azimuth is controlled so that it coincides with the antenna null plane, as shown in FIG. 1. Range to the missile is determined by precise range tracking. The missile normally flies nearly horizontally until it reaches a range that is equal to the target range. In practice this is determined when the time delay signal indicative of target range equals a time delay signal provided as a function of missile range. When the missile reaches this range it is commanded to fly down at a constant range corresponding to the target range, resulting in a terminal dive on the target. This eliminates the need to know target altitude.

Figure 2:
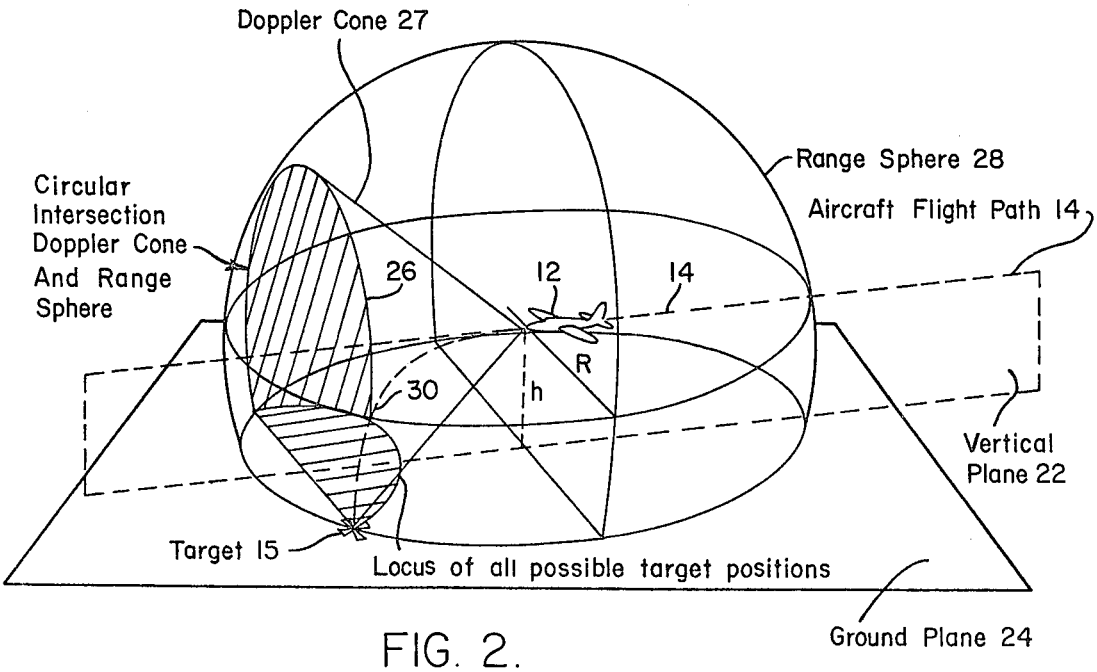

In the system of the present invention a radar mapping subsystem is assumed to be incorporated. It provides the operator with a displayed map. therefrom the operator selects a target by designating its position in terms of range and azimuth which are based on two characteristics of the radar return, such as time delay and doppler frequency shift. The time delay defines a range and confines the target location to a constant range sphere. Doppler frequency shift defines an angle off the flight path 14 and confines the target location to the surface of a cone, centered about the aircraft velocity vector with its apex at the aircraft 12. Thus the selected target lies on the intersection of the range sphere and the doppler cone. As seen from FIG. 2, the flight path 14 of aircraft 12 is in a vertical plane 22 at an elevation h above a ground plane 24 containing target 15. The target 15 lies on the circumference of a perpendicular circle 26 centered about path 14. The circle 26 represents the intersection of a doppler cone 27 and a range sphere 28 of radius R. Circle 26 is often referred to as the circle of constant range doppler frequency.

In the present example the missile, which is released from the aircraft, flies horizontally toward the target in a plane which coincides with the antenna null plane. When the missile range reaches the target range, i.e., the range sphere 28, it is commanded to fly down the range sphere 28 as indicated by dashed line 30. Missile guidance is achieved by incorporating a beacon transponder in the missile to provide a strong signal so that very small deviations of missile azimuth from the null plane can be detected. Range to the missile is determined by conventional precise range tracking of the beacon transponder returns.

Basically, in the aircraft airborne system a digital computer is included. The signals from the beacon transponder and the range tracking equipment are sent to the computer where missile correction commands are computed. These commands are transmitted to the missile for its azimuth and range control. As will be described hereafter, pulse coding and delay are employed to insure that the missile response does not arrive during the time that normal mapping data is received.

Figure 3:
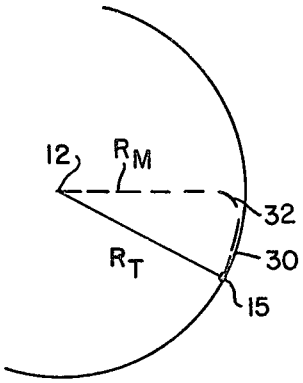

The terminal guidance of the missile is also represented in FIG. 3. Therein, $R_T$ represents the target range, numeral 30 the arc of intersection of the antenna null plane and the range sphere, the arc corresponding to dashed line 30 in FIG. 2, and $R_M$ is the missile range. In practice, in accordance with the present invention, the missile flies a nearly horizontal course until it approaches the target range when it is commanded to fly down to intercept and follow the arc of intersection 30 for a terminal dive on the target. The change of missile course from the horizontal direction to the downward flight is represented in FIG. 3 by dashed line 32. It should be appreciated that since the missile approaches the target along the arc of intersection 30, which is at a range equal to the target range $R_T$, the target's altitude need not be known for missile impact on the target.

Figure 4:
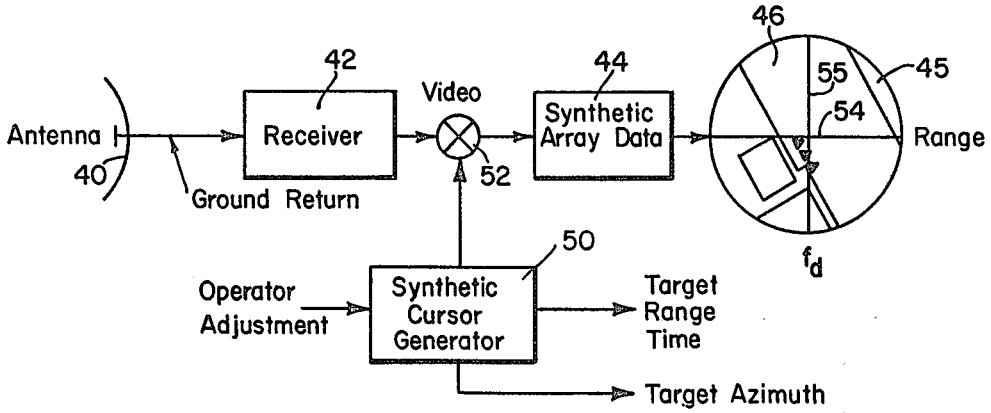
FIG. 4 is a block diagram of one significant part of the system of the present invention.

A radar mapping subsystem which is particularly adapted for the practice of the present invention is a high resolution synthetic array radar which, as shown in FIG. 4, comprises an antenna 40, a transmitter (not shown), a receiver 42, a synthetic array data processor 44 and a display 45. From a map 46, displayed on the display 45, an operator can identify and designate a target to which a missile should be launched. The target is selected in terms of synthetic array coordinates. The target's range is designated in terms of a time delay, where the time delay defines a range sphere, and target azimuth is designated in terms of a doppler frequency shift, which defines an angle off the flight path and confines the target location to the surface of a cone centered about the aircraft velocity vector with its apex at the aircraft.

Target selection is accomplished by inserting a time-gated signal and a fixed frequency signal into the radar video. These two signals are provided by a synthetic cursor generator 50, which is subject to operator adjustments. As will be pointed out hereafter the generator 50 is provided with numbers from a digital computer which is subject to operator adjustments. These numbers are used by the generator to produce the time gated signal and a fixed frequency which corresponds to the range and related to the azimuth of the selected target, respectively. The signals from the generator 50 are added to the radar video by an adder 52. As a result, the selected target is caused to be displayed at the point of intersection of two orthogonal lines or cursors 54 and 55 which are presented on display 45. Line 54 represents the selected range and line 55 the selected azimuth. Thus, target selection is achieved by controlling generator 50 to cause the target to coincide with the point of intersection of the two lines.

In practice since the signals from generator 50, representing the cursors, are summed up with the radar video, the target movement on the display is not observed until a next synthetic array is displayed. Therefore, the accurate designation of a target is dependent on the minimum time delay between successive maps. Such delay may require several adjustments of generator 50 until the cursors intersect the desired target. However, once the target is precisely designated, its range is the same as that represented by the constantrange cursor 54 and its doppler frequency shift is that represented by the constant-doppler cursor.

It should again be stressed that the actual target range and azimuth are not directly produced or computed. Rather the system is used and adjusted until the target is displayed in coincidence with the cursors whose range, in terms of a time delay signal, and doppler frequency are known to a very high degree of precision. It is the time delay signal and the frequency which are used for missile guidance.

Figure 5:
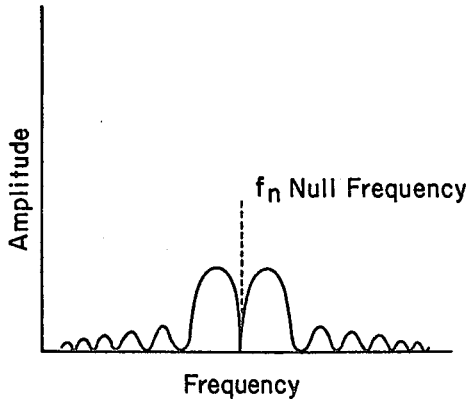
FIGS. 5 and 6 are diagrams useful in explaining the circuitry associated with aligning an antenna so that a target lies on the antenna's null plane.

From the foregoing it is apparent that the azimuth reference of the missile is the null plane of the antenna azimuth pattern. In order to achieve high guidance accuracy, precise pointing of the antenna is required. In order not to depend on precise antenna pointing, on angle measurements by gimbal pickoff devices or be affected by antenna bore-sight errors and random and atmospheric refraction a new method must be employed. In this new method the doppler frequency at the null of the signal return in the antenna difference pattern is determined. This doppler frequency, designated $f_n$ in FIG. 5, is then compared with the doppler frequency which is determined for the target when the target is displayed along the azimuth cursor and an error signal is generated.

This frequency error signal can be used in either of two ways. The first, and the one chosen here to describe a particular embodiment of the invention, applies the error signal to drive the antenna azimuth control in the direction to null the error. This is here designated as the target-tracking mode. In it the azimuth missile command generator derives its error input from the monopulse return from the missile beacon, whereby the missile is caused to fly in the null plane.

The second choice, designated here the missile-tracking mode, closes the antenna pointing loop in the conventional way to track the missile, which can be done very precisely with a strong transponder in the missile, and uses the target frequency error signal to generate guidance commands for the missile. The two choices have substantial impact on cost and accuracy of the system. In the following, in order to simplify the description, only the first choice will be presented.

Figure 6:
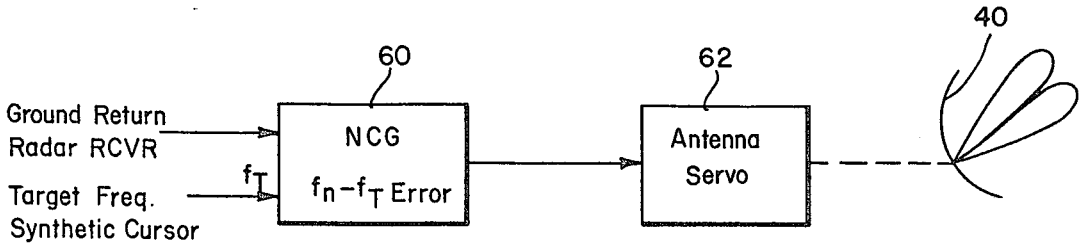

The frequency error signal is generated in a unit called a null command generator (NCG), designated in FIG. 6 by numeral 60. The null command generator may be assumed to receive the target's doppler frequency $f_T$ from the cursor generator 50 and target range gated sum (Σ) and difference (Δ) signals from the receiver 42. The generator 60 normalizes the ground return for nonlinear backscatters in the target area to derive $f_n$. The output of the null command generator 60 representing the difference between $f_n$ and $f_T$ activates an antenna servo 62 which drives the antenna 40. Thus, the null of the antenna difference pattern is aligned accurately with the ground point of interest, i.e., the target, without regard to the physical position of the antenna or the aircraft altitude.

Summarizing the aspects of the invention, described so far, it is seen that in the present invention the cursor information is not applied directly to the display in the normal manner, but rather to the synthetic array data processor. Therefore, the cursors are displayed precisely as if they were incoming radar signals or video. As a result, no distortion or other nonlinearity which can occur in the synthetic array data processor or the display will affect the separation of the cursors from the target, once the latter is displayed at the point of intersection of the two cursors.

Another novel aspect of the invention is the use of the null command generator which uses the relationship between frequency and amplitude in the monopulse null to obtain a very accurate estimate of the position of the antenna null and controls it to be aligned with the target. A further novel aspect of the invention is the missile guidance. Herein, the monopulse null plane of the antenna is used to guide the missile in azimuth. In range the missile is guided by controlling it to fly horizontally in the monopulse null plane until it reaches the target's range, i.e., the target's range sphere. Then the missile is caused to fly down the range sphere to the target rather than along the circle of constant range/doppler frequency.

It should be pointed out that the term monopulse as used in the present application, actually refers to any known means for sensing angle-off-axis of a radar target. In particular, modern electronic scanning, and multi-pulse bursts, where single pulses do not give the necessary information, can be used for generating the frequency error signal. Since a sensitive frequency error detector necessarily requires a long integration time, comparable to that required to generate a synthetic array, single-pulse detection is not required, and in the embodiment described here a great many pulses are actually used.

Figure 7:
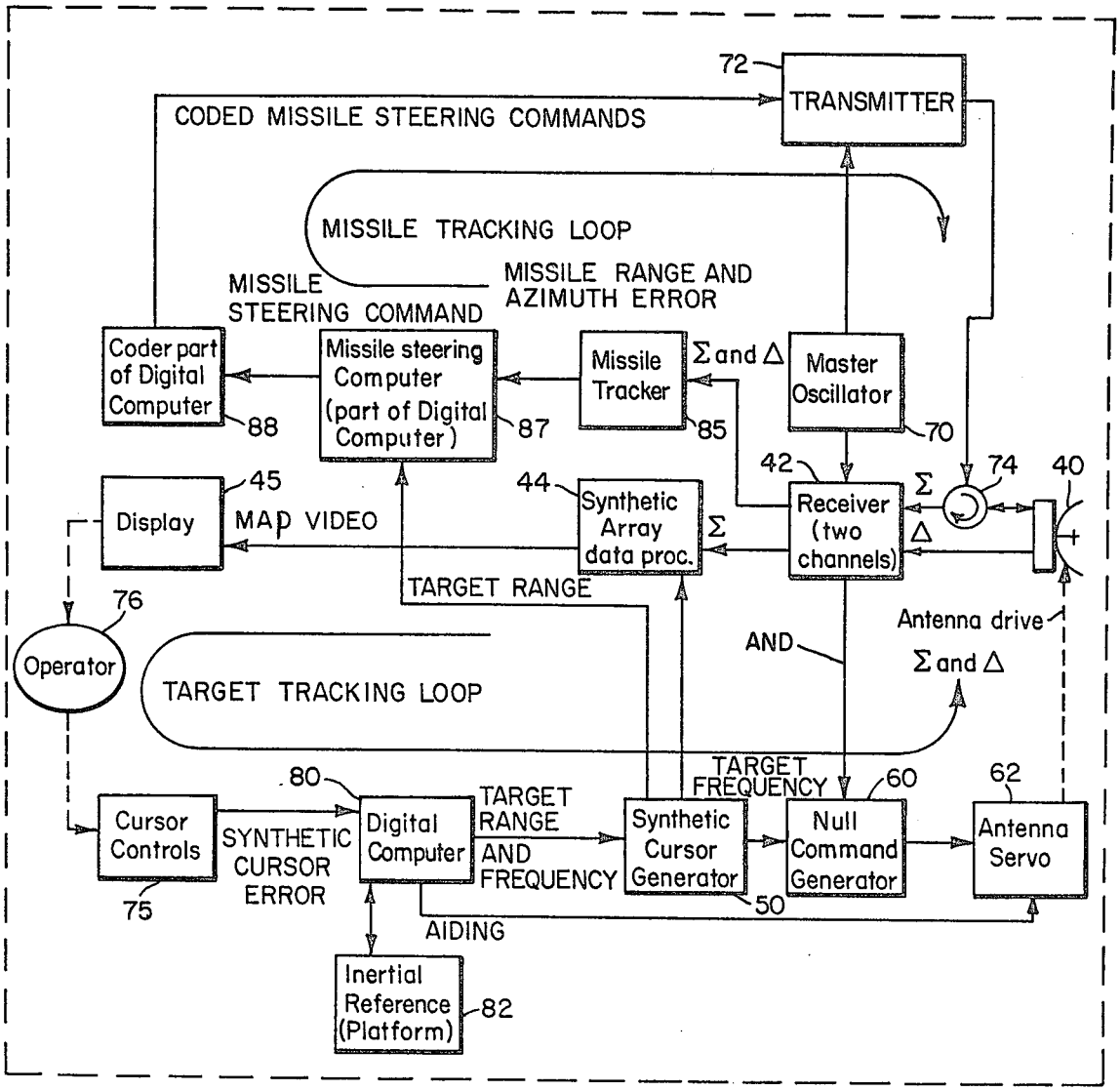
FIG. 7 is an overall block diagram of the circuitry aboard the aircraft.

Attention is now directed to FIG. 7 which is a block diagram of the equipment carried by aircraft 12 (FIG. 1). In FIG. 7, elements like those previously described are designated by like numerals. The equipment includes a master oscillator 70 which activates a transmitter 72. Its output is supplied to antenna 40 through a circulator 74 to illuminate the ground including target 15, as well as supply coded missile steering commands to a missile, such as missile 16 (see FIG. 1) once the latter is launched. Returns from the illuminated ground including the target are received by the antenna 40. The sum (Σ) pattern is sent to the receiver 42 through circulator 74 and the difference (Δ) pattern is directly supplied to the receiver, which is a two-channel receiver.

The sum output of receiver 42 is supplied to the synthetic array data processor (SADP) 44 which supplies a video map to display 45. As is appreciated by those familar with the art in such a map, each small incremental patch of ground is displayed in terms of its range (R) which in FIG. 4 is assumed to be along the vertical axis and its azimuth represented by its doppler frequency which is assumed to be in the horizontal axis.

In addition to the receiver sum output the SADP 44 is supplied with a time delayed pulse, representing range and a constant frequency signal from the synthetic cursor generator 50. The particular range and frequency, provided by the generator 50, are displayed on the display by the fixed cursors 54 and 55 respectively. Thus the patch of ground displayed at the point of intersection of the two cursors is one which has the same range and frequency provided by generator 50. By changing the range and frequency supplied by generator 50, the displayed map is shifted on the face of the display so that a different point of the map which has a range and frequency corresponding to the changed range and frequency from the generator 50 is displayed under the cursors' point of intersection.

As seen from FIG. 7, the airborne equipment includes manual cursor controls 75 which are operated by an operator 76, viewing the display 45 for target selection. The output of controls 75 is supplied to a digital computer 80, whose output is supplied to generator 50. The digital computer is also in two-way communication with an inertial reference or platform 82. In operation the operator views the display to select a target to which a missile should be directed. Assuming that the selected target is not at the cursors' intersection which is at the display center, the operator uses the controls to supply synthetic cursor error signals in range and frequency to the computer 80. The latter uses these signals and updates the numbers corresponding to range and frequency which are supplied to the generator 50 which generates the updated range and frequency displayed by the cursors. As a result, the selected target moves closer to the display center. As seen from FIG. 7, the digital computer 80 uses the range and frequency information from the controls 75 to control the antenna servo 62 to in turn control the antenna 40 to illuminate the ground centered about a patch at the range and frequency defined by the computer output.

It should be appreciated that since a finite time is required for the SADP 44 to process the incoming data from the receiver to produce the map, the adjustments of the range and frequency, produced by the controls 75, are only displayed on a subsequently displayed map. Thus several adjustments may be needed until the selected target is placed at the display center. Such a target has the range and frequency provided by the generator 50 and displayed by the cursors. Since the aircraft is in motion the range and the azimuth to the target change continuously. Such changes are accounted for by the computer 80 which updates the range and frequency many times per second, based on the components of aircraft velocity which are provided by the inertial reference 82.

Once a selected displayed target is positioned at the display center, the operator designates it as the chosen target by supplying the computer with an appropriate signal. This signal starts the running of a clock in the computer. If during the flight, due to errors in the updating of the range and frequency of the target caused by accumulated errors in the inertial reference, the target tends to drift away from the display center, the operator repositions the target by means of cursor controls 75. Then he again supplies a signal to the computer 80. The latter uses the elapsed time between the two signals and the corrected range and frequency errors to control and adjust the signals from the inertial reference 82, to insure that the repeatedly updated range and frequency numbers from the computer actually represent the range and frequency of the target which continues to be displayed at the center under the intersection of the cursors. Thus the target's range and frequency are those provided by generator 50.

As previously explained and as seen from FIG. 7, the target frequency, designated $f_T$, from generator 50 as well as the sum ($\Sigma$) and difference ($\Delta$) oututs of receiver 42 are supplied to the null command generator (NCG) 60. As herebefore stated, the function of the latter is to determine the doppler frequency at the null of the signal return, designated $f_n$ in FIG. 5, and provide an error signal which corresponds to the difference between $f_T$ and $f_n$. This error signal is supplied to the antenna servo 62 to cause the antenna to point to the target so that the latter lies in the monopulse null plane. When this is achieved $f_n = f_T$. Alternately stated, the NCG uses the target frequency $f_T$, supplied thereto from generator 50, and monopulse null plane frequency $f_n$ derived therein, to provide an error signal to cause the antenna to point to the target so that the latter lies in the monopulse null plane. One embodiment of an NCG capable of performing such functions is shown and described in copending U.S. patent application Ser. No. 736,932, filed on June 5, 1968 by the applicant of the present application and assigned to a common assignee. This embodiment represents only one arrangement for using $f_T$ and deriving $f_n$ to provide an error signal representing the difference therebetween.

From the foregoing description of FIG. 7, it is seen that in accordance with the present invention, the airborne equipment includes an arrangement whereby a map of terrain is displayed in terms of range and doppler frequency of the various terrain patches. Controls and means are provided which enable an operator to select a specific target in the displayed map and generate range and frequency which correspond to those of the target when the latter is displayed at a specific point on the display. The target's frequency is used by means, such as the NCG 60, to generate an error signal to control the pointing of the antenna so that the monopulse null plane frequency equals the target frequency. Thus the target lies in the monopulse null plane. As pointed out in inertial reference and a digital computer are used to repeatedly update the target range and frequency as a function of aircraft velocity.

The equipment shown in FIG. 7 further includes the circuits necessary to track and guide a missile which is launched, once the target's range and frequency are determined and the target lies in the monopulse null plane. The missile airborne equipment is diagrammed in FIG. 8.

As seen from FIG. 7, the airborne equipment includes a missile tracker 85 which receives sum and difference outputs from receiver 42. These are in response to returns from the missile rather than from the illuminated ground. The missile tracker 85 derives the missile's range as well as its azimuth error which is the deviation of the missile from the monopulse null plane in azimuth. It should be pointed out that in the present invention the monopulse null is controlled in doppler frequency and the missile is steered in azimuth about the null even though the missile's true azimuth is not known. It is the deviations of the missile in azimuth from the null plane which are corrected.

The missile range and the azimuth error as well as the target range from the generator 50 are supplied to a missile steering computer 87, which in practice is part of the digital computer 80. The missile steering computer 87 provides missile steering commands. These include an azimuth steering command to reduce the azimuth error so that the missile flies along the monopulse null plane. It may also include a range command which depends on the difference between the target and missile ranges which are determined in the present invention as time-delay signals. This command becomes very significant as the missile range approaches the target range when the missile trajectory is changed from a horizontal direction down the range sphere, as previously explained in conjunction with FIG. 3. The steering commands are digitally coded by a coder 88 which in practice is also part of computer 80. The coded missile steering commands are then supplied to the transmitter 72 which transmits them to the missile, via antenna 40.

Figure 8:
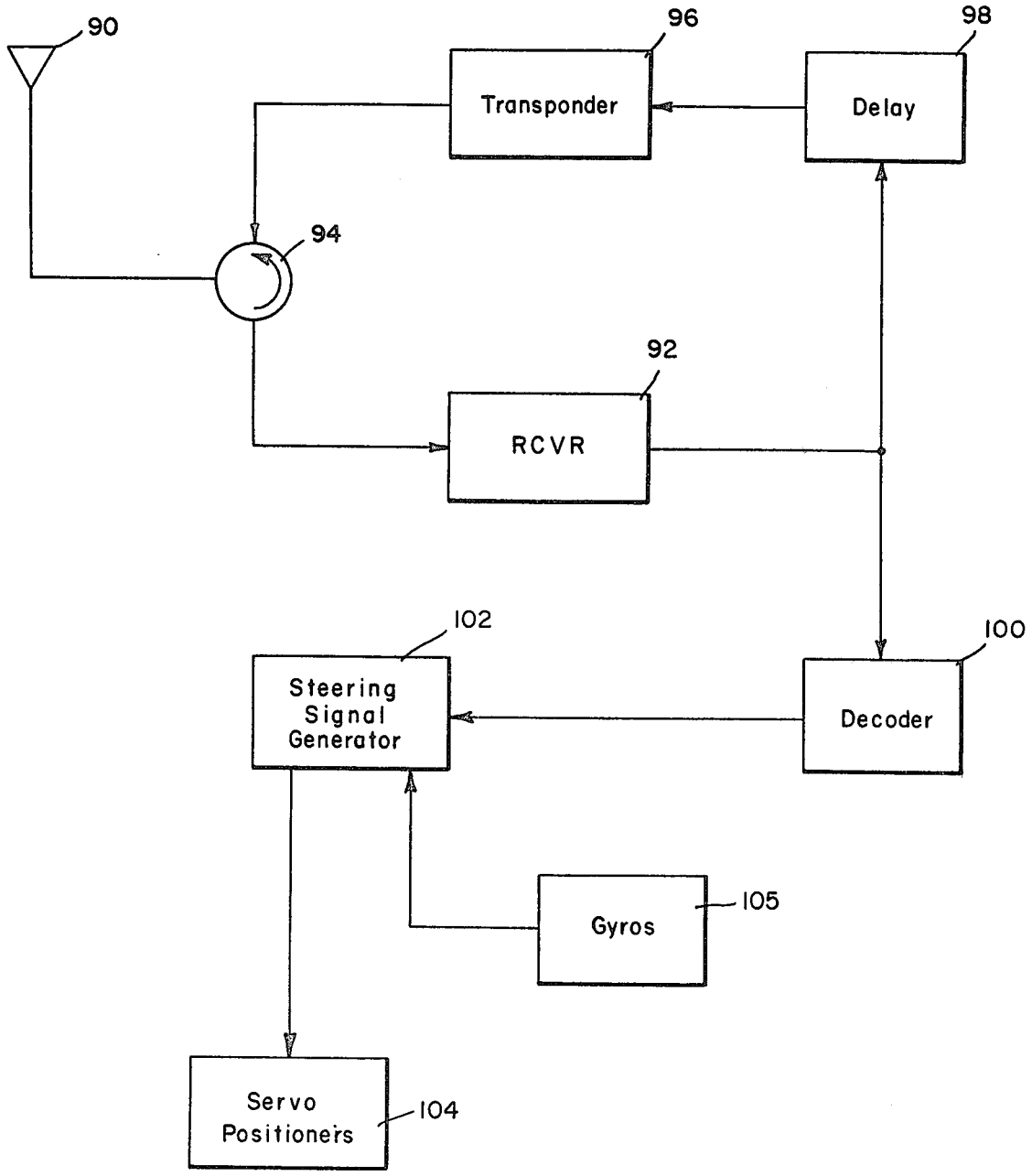
FIG. 8 is a block diagram of the missile-borne circuitry.

As seen from FIG. 8, the missile airborne equipment includes an antenna 90. Signals received by this antenna are directed to a receiver 92 through a circular 94. The actual radio frequency (r.f.) signals, received by the receiver, are supplied to a transponder 96 through a delay unit 98. The transponder's output is retransmitted to the airplane, via antenna 90. The purpose of this arrangement is to provide a strong return signal from the missile and not depend on the missile skin return which has a low signal-to-noise ratio. Alternately stated, the missile transponder supplies a signal which is much stronger than terrain returns so that the missile tracker can distinguish the missile returns.

The delay is chosen to prevent the transmitter of the transponder 96 and receiver 92 from running simultaneously and thereby prevent oscillation. Different frequencies could theoretically be used. However, this would require a separate receiver in the aircraft for the missile returns. Furthermore different frequencies would require taking account for different propagation paths, the fact that the atmosphere length is different at different frequencies and that it has different curvature at different frequencies. Thus, all of these problems are eliminated by operating the missile receiver and transponder at the radar frequency and by delaying the transponder input. Also the delay is chosen so that the missile returns do not arrive simultaneously with ground returns in the neighborhood of the target.

As shown in FIG. 8, the receiver output, representing the coded missile steering commands received from the aircraft, is supplied to a decoder 100 whose output is the steering commands. These are supplied to a sterring signal generator 102 which drives servo positioners 104. In response thereto the missile is adjusted in azimuth and range with the positions being sensed by gyros 105 which send feedback signals to the generator 102 to stabilize the missile in its corrected position.

Attention is again directed to FIG. 7. It should be appreciated by those familiar with radar processing techniques, and particularly those familiar with synthetic array data processing, that various techniques may be employed to generate the range and azimuth cursors which respectively represent a given range and doppler frequency, and to display these cursors on a display. It is further appreciated that a map of the illuminated area may be displayed in which each incremental portion is displayed at distances from the cursors corresponding to the difference between the cursors' azimuth and range and those of the incremental area portion. By changing the azimuth and the range which the cursors define, the map is effectively shifted so that when a selected incremental area portion, representing a target, is displayed at the intersection of the cursors, the azimuth, represented by the azimuth cursor, and the range, represented by the range cursor, respectively, represent target azimuth and target range.

As previously described in conjunction with the description of FIG. 7, it is digital computer 80 which provides a range number and a frequency number to generator 50, which generates the range and frequency of the cursors. When the target is displayed at the intersection of the cursors, the numbers supplied to the generator 50 and therefore the range and frequency signals provided thereby are indicative of target range and doppler frequency. As is appreciated, since the aircraft is in motion the target range and azimuth change continuously. This is accounted for by the digital computer 80 by changing the numbers supplied to generator 50 as a function of the signals from the inertial reference 82.

Figure 9A:
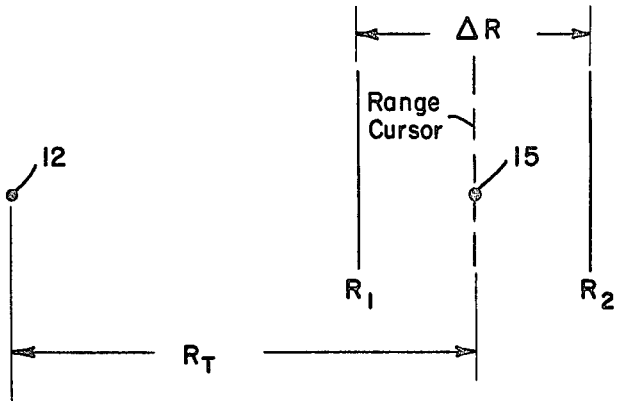
FIGS. 9*a*, 9*b*, 9*c* and 10 are diagrams useful for explaining the manner of generating a range cursor and adjusting a selected target to coincide therewith.
Figure 9B:
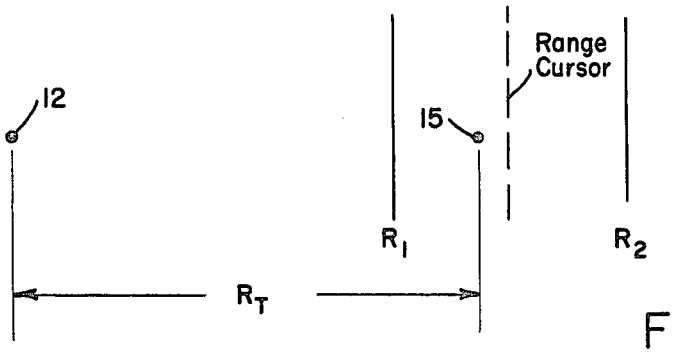
Figure 9C:
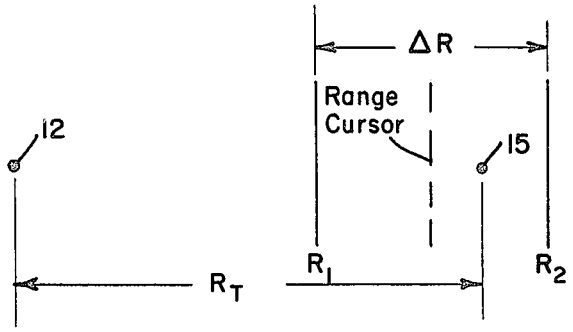

A specific embodiment of the part of the synthetic cursor generator 50 for generating the range cursor will now be described in conjunction with FIG. 9*a*. This description is provided for explanatory purposes rather than to limit the invention thereto. Let it be assumed that the map which is displayed is one which is intended to include an area in a range interval $\Delta R$ such as between ranges $R_1$ and $R_2$ from the aircraft 12. $\Delta R = R_2 - R_1$ and in one example was chosen to be 3000 ft. The target range $R_T = R_1 + \Delta R/2$ only when the target is displayed at the display center under the range cursor. Since $\Delta R$ is fixed, if $R_1$ is known when the target is at the center, $R_T$ is easily obtained. In one embodiment the range number from the computer is adjusted until the target is displayed at the center. This number represents $R_1$. By delaying the signal corresponding to $R_1$ by $\Delta R/2$ the range target signal is obtained. Thus in the example in which $\Delta R = 3000'$, the delay corresponds to 1500'. Clearly if the target is displayed on one side of the cursor at a range less than the range cursor, the number corresponding to $R_1$ is too great, as shown in FIG. 9*b*, while being too small (see FIG. 9*c*) when the target is displayed at a range which is greater than the range represented by the range cursor.

Figure 10:
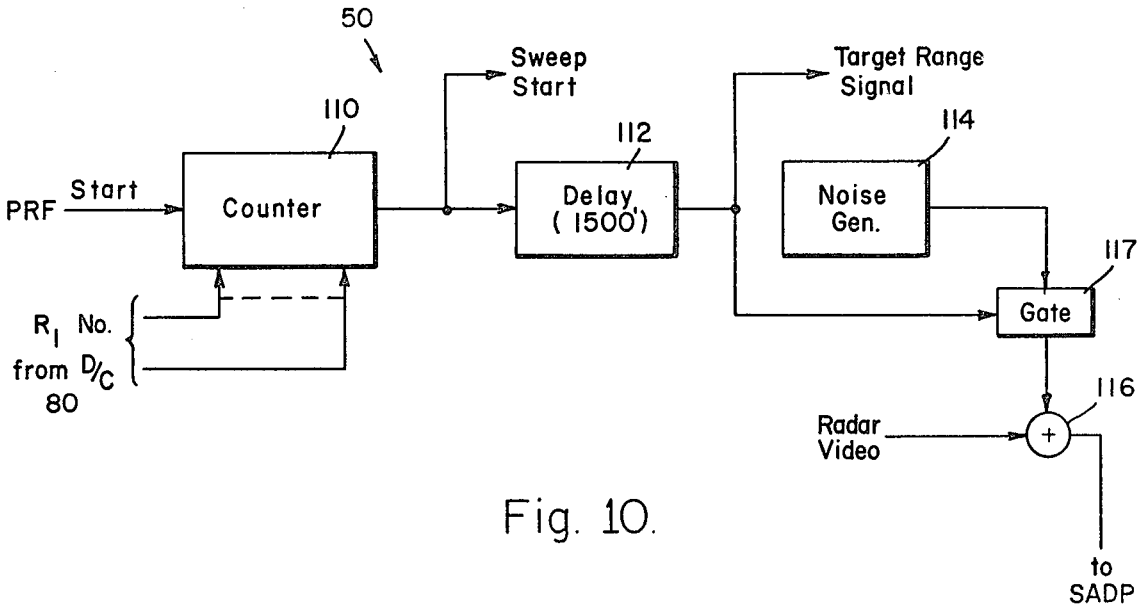

As seen in FIG. 10, the cursor generator 50 includes a start counter 110. It is loaded by the computer 80 with a digital number. Each PFR from the radar system activates the counter to count down at a selected rate such as for example 100 MHz which corresponds to 5 ft increments. When the count reaches zero, the counter's output represents a sweep start signal or a range pulse to start displaying the map. This output is also supplied to a fixed delay unit 112 corresponding to 1500 ft. As will be pointed out after proper adjustments, the output of unit 112 represents the target range signal.

The range cursor circuitry also includes a noise generator 114, whose output is supplied to an adder 116 through a gate 117. The latter is opened by the output of delay 112 for a brief duration, e.g., corresponding to a 5 ft increment. Adder 116 adds the noise generator output to the radar returns and supplies them to the SADP. The output of noise generator 114 represents returns from all azimuths at a range equal to the number from the computer plus 1500 ft.

Clearly the target is displayed at the center in range, only if the number from the computer corresponds to $R_1$ which equals $R_T$ less 1500 ft. If the number is too great (FIG. 9*b*), the target returns would be received prior to the signals from the noise generator and therefore the target would be displayed on one side (ahead) of the range cursor. On the other hand if the number is too small, the target returns would be received after the noise signals, and therefore, the target would be displayed on the other side of the range cursor. By adjusting the number from the computer to correspond to $R_1$ which is $R_T-1500$ ft, the target is displayed at the range cursor position. Thus when the target is at the range cursor position, the target range is known. The target range signal is the otput of the fixed delay 112.

From the foregoing it is thus seen that the range cursor is generated by providing signals at all azimuths, represented by the noise from generator 114 which represents fictitious returns at a range equal to the number from the computer plus ½ the display range, e.g., 1500 ft. Since the sweep start is provided before the delay of 1500 ft, which corresponds to half the display range, the cursor is always displayed at the display center. Thus, by adjusting the number from the computer, the center of the map represents and is the target range. It should be appreciated that in the real world the map slides over the target. However, in the display the target appears to slide under the display surface.

An analogous technique is employed to generate the azimuth cursor. Herein returns from all ranges at one frequency, representing a doppler frequency or azimuth, needs to be generated to produce the cursor. The particular frequency which is chosen is that of the center frequency of the filter bank in the SADP and is hereafter referred to as $f_{off}$. This insures that the azimuth cursor is displayed along the display center. The system includes a unit 120 (see FIG. 11) which acts as a variable frequency oscillator. However in practice it consists of a counter and a switch. Each time the counter counts down to zero it activates the switch to remain in one of two states and thereby provide one of two output levels until the counter counts down to zero once more at which time the switch provides the other output level. Thus the output of the unit is a squarewave 122, where each half cycle is of a duration which depends on the counter's clock rate and the number to which it was set. For example, assuming that the clock rate is 10 MHz and the clock is set to 500, it takes 50 μs to count to zero. Thus the unit would provide a half cycle period of 50 μs. The unit is set by numbers from the digital computer 50. Thus these numbers in a sense control the frequency of the squarewave output of unit 120 which is designated $f_c$ for cursor frequency. In practice these numbers are adjusted until $f_c$ equals the unknown doppler frequency or azimuth of the particular target of interest which is designated $f_T$. When $f_c=f_T$, the target is displayed under the azimuth cursor.

Figure 11:
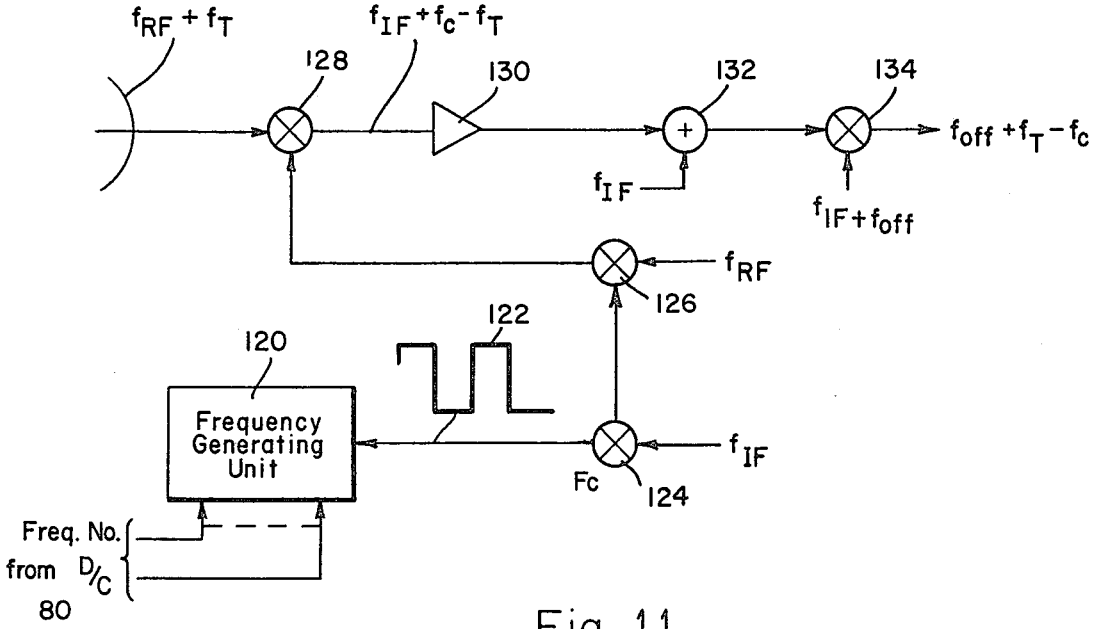
FIG. 11 is a block diagram of circuitry for generating an azimuth cursor and for controlling it so as to display a selected target in coincidence therewith.

As seen from FIG. 11, $f_c$ is mixed in mixer 124 with $f_{IF}$ which is the intermediate frequency in the master oscillator 70 (FIG. 7). The output of mixer 124 is mixed with $f_{RF}$ from the master oscillator in mixer 126 whose output is $f_{RF}+f_{IF}+f_c$. It is in turn mixed with the radar returns from antenna 40 in mixer 128. The radar returns are designated by $f_{RF}+f_T$ where $f_T$ represents the doppler frequency of any illuminated target.

The output of mixer 128 is $f_{IF}+f_c-f_T$. It is amplified in amplifier 130 to whose output energy at $f_{IF}$ is added in adder 132. The output of the adder is mixed with $f_{IF}+f_{off}$ in mixer 134 whose output is $f_{off}+f_T-f_c$.

It should be apparent that when $f_T=f_c$, the output of mixer 134 is $f_{off}$. Thus all the bank of filters centered at $f_{off}$ are loaded with the $f_{IF}$, energy added by adder 132, thereby producing the azimuth cursor along the display center. It should be stressed that thereat only those targets at all ranges with a doppler frequency $f_T$ which equals $f_c$ are displayed. Clearly if $f_T \neq f_c$ the particular target will not be displayed along the azimuth cursor. However by adjusting $f_c$ to equal $f_T$ of the particular target, the target is displayed along the azimuth cursor. Thus when the target is displayed along the azimuth cursor $f_c$, the number from the computer 80 is indicative of target azimuth.

Although herebefore it was assumed that the azimuth cursor is generated in generator 50, this was done for explanatory purposes only. In practice the circuitry shown in FIG. 11 is partially in the generator 50 as well as in the master oscillator and the receiver 42 so as to minimize duplication of components or circuits. Irrespective however where the circuits are located when the selected target is displayed under the azimuth cursor, $f_c$ from unit 120 equals $f_T$. It is supplied to the NCG 60 which uses the Σ and Δ returns from the target range to generate an error signal which represents the difference between the target azimuth as defined by $f_c$ and the monopulse null azimuth so that the null lies in a plane including the target. One embodiment of an NCG having such capabilities is described and claimed in the previously referenced copending U.S. patent application Ser. No. 736,932, entitled "Radar Sensing Generator In A Monopulse Radar System".

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A system for guiding a remotely controllable missile along a flight path towards a designated target area, said system comprising:

radar means for transmitting energy to and receiving energy from a selected area of terrain, said radar means including a monopulse antenna having a pattern with a null plane in the azimuth dimension;

cursor generator means, including manual control circuitry, for providing cursor signals indicative of the relative range and doppler frequency of a selected target portion in said terrain area as designated by the manual control circuitry;

display means responsive to said received energy and to said cursor signals presenting a map display of said selected area; and for presenting an indication of the relative position of the selected target portion of said terrain area;

null command generator means for measuring the relative doppler frequency of energy received along said null plane and for positioning said antenna such that the relative doppler frequency of said null plane energy is substantially the same as the doppler frequency of said cursor signal;

means for sensing the position of said missile in said pattern and for remotely controlling said missile so that its flight path is substantially along said azimuth null plane.

2. A system carried by an aircraft for guiding a missile to its selected fixed target comprising:

signal transmitting and receiving means including the transmitter, receiver and a monopulse antenna for transmitting signals to an area including said target and to said missile, and for receiving return signals from said area including said target and said missile;

first means for utilizing the signals received from said area for generating a range signal representing the range of said target and a frequency signal repersenting the azimuth between the target direction and the aircraft flight direction;

second means responsive to the return signals received from said area and to said frequency signal for controlling the antenna position so that the target lies in the monopulse null of said antenna; and third means responsive to said signals from said missile and the range signal from said first means for supplying said transmitter with steering command signals for transmission to said missile to control the range of said missile as a function of its range, as determined by said third means from the missile return signals, the range signal from said first means, and to control the missile and azimuth as a function of the missile deviation from said monopulse null plane.

3. In a vehicular radar system adapted for guiding a transponder equipped missile to a target the arrangement comprising:

means for transmitting radar signals to a selected area of terrain and for receiving return signals from said area, said first means including a monopulse antenna having a pattern with a null along the azimuth plane;

means for processing the return signals from said area so as to designate an incremental portion of said area at a selected range and having a selected doppler frequency as a selected target and for controlling the antenna so that the null thereof lies in a plane including said selected target;

means for generating a range-azimuth indicating signal representing the range and azimuth of said selected target as a function of the range and doppler frequency of said return signals;

means for transmitting signals to said missile for directing said missile to said target;

means for receiving transponder signals returned from said missile; and means for processing the signals received from said missile and said range signal for generating missile guidance commands as a function of said missile deviation from the plane of said null pattern and in range as a function of said transponder signals representative of the actual missile range and said range signal representing target range.

4. In a vehicular radar system adapted for guiding a transponder equipped missile to a target the arrangement comprising:

transmitting and receiving means for transmitting radar signals to a selected area of terrain and for receiving return signals from said area, said first means including a monopulse antenna having a pattern with a null along the azimuth plane, said means for transmitting signals to a missile directed to said target and for receiving signals returned therefrom;

means for processing the return signals from said area for designating an incremental portion of said area at a selected range and having a selected doppler frequency as a selected target and for controlling the antenna so that the null thereof lies in a plane including said selected target; and means for processing signals returning from said missile for generating a missile azimuth command signal and supplying to said common transmitting means for transmission to said missile for controlling its azimuth so that the missile lies in the plane of the antenna monopulse null.

5. In a vehicular born radar system adapted for mapping a ground target and directing a missile thereto, the arrangement comprising:

signal transmitting means;

signal receiving means;

a monopulse antenna coupled to said transmitter and receiver for transmitting radar signals to an area of terrain and for receiving return signals therefrom;

signal processing means for processing said return signals;

display means for displaying a map of said area as a function of range and doppler frequency of said return signals;

means for generating a range signal and a doppler frequency signal representative of the range and doppler frequency of the incremental portion of said area being displayed at a preselected point on said display for designating said incremental portion as a selected target;

means for utilizing said doppler frequency signal from said generating means and the doppler frequency of the return signals received by said receiver from said area for generating an error position signal and for controlling the position of said antenna with said error position signal so that said plane of the antenna null intercepts said selected target;

means coupled to said generating means for updating the range signal and the doppler frequency signal provided by said generating means as a function of the velocity of said vehicle in which said system is borne so that said range signal and frequency signal represent the range and target doppler frequency with respect to the moving vehicle;

said signal transmitting means transmitting signals to said missile directed toward said target;

said antenna receiving returns from said missile and supplying said returns to said receiver;

missile guidance means including first means responsive to said missile return signals from said receiver for deriving missile range and deviation of said missile from the plane of the antenna monopulse null in azimuth, said missile guidance means further includes second means being responsive to said first means and to said range signal from said generating means for providing missile guidance commands; and said transmitter transmitting said comands to said missile for controlling said missile azimuth so that said missile remains in said monopulse null plane and for controlling missile range as a function of said missile's range and said target's range as represented by said range signal from said generating means.

* * * * *